US005885176A

United States Patent [19]

Wong et al.

[11] Patent Number: 5,885,176

[45] Date of Patent: Mar. 23, 1999

[54] PORTABLE VOLLEYBALL NET AND STAND

[76] Inventors: Ryan T. Wong, 204 Coy Dr., #4, San Jose, Calif. 95123; Eric W. Ronsheimer, 3087 Sulphur Springs Ct., San Jose, Calif. 95148

[21] Appl. No.: 979,249

[22] Filed: Nov. 26, 1997

[51] Int. Cl.[6] ..... A63B 61/00

[52] U.S. Cl. ..... 473/490

[58] Field of Search ..... 473/473, 490, 473/492, 493, 494, 495

[56] References Cited

U.S. PATENT DOCUMENTS

| | | | |
|---|---|---|---|
| 3,328,928 | 7/1967 | Frye | 473/492 X |
| 4,415,163 | 11/1983 | Schoenig | 473/492 |
| 4,830,382 | 5/1989 | Wheeler | 473/492 |
| 5,156,408 | 10/1992 | Hall | 473/492 |
| 5,269,533 | 12/1993 | Kellams | 473/492 |
| 5,303,932 | 4/1994 | Kessler | 473/492 |
| 5,326,109 | 7/1994 | Robl | 473/492 |

*Primary Examiner*—William H. Grieb
*Attorney, Agent, or Firm*—Gerald L. Robertson

[57] ABSTRACT

Applicant's invention defines a portable volleyball net and stand which comprises two standards having a set of guys in a "V" configuration connected to ground anchors and adjustable for tensioning the top of each standard. The lower net edge line passes through slots in the standard and is either directly coupled to the ground via two lines in a "Y" configuration, or is connected to guys, providing a single tensioning capability. Ground anchors of a coiled configuration are provided for strength and stability. The line connected to the top edge of the net is directed through a slot in the standard and looped about a fixed ring therein, finally exiting the standard through a second slot, for a different net height. The standards are capable of being assembled together providing portability to the system.

4 Claims, 6 Drawing Sheets

PORTABLE VOLLEYBALL NET AND STAND

FIELD OF THE INVENTION

The present invention relates to a portable, regulation volleyball net and stand system for playing the sport of volleyball.

BACKGROUND OF THE INVENTION

At present, a variety of portable volleyball apparatus have been designed to allow the transport of such a game apparatus for enjoying the sport at the beach, in a backyard or park, or otherwise.

The reader's attention is directed to U.S. Pat. No. 5,303,932, to Kessler, wherein a typical net and stand configuration is disclosed. In Kessler, a weighted base is provided for the insertion of an upright leg at an angle to provide tension and stability for the net during play. While a configuration like Kessler's may be perfectly satisfactory for recreational play, serious volleyball players such as professionals who play the game vigorously, contacting the net when spiking the ball or blocking an opponent's shot, or even where the ball is forcefully driven into the net, will not find such a configuration suitable for professional or aggressive amateur play. For professional play, the net must maintain regulation height and tension requirements throughout play.

A further attempt at providing a portable net support is disclosed in U.S. Pat. No. 5,156,408 to Hall, where an inclined support is added to a vertical standard to provide extra stability. Spikes on the underside of a T shaped support provide the locating and gripping means of each standard, defining the net tension predominantly by the distance between the standards. In this case, the stability of the net system depends on the ability of the spikes to resist shear forces due to the inward net tension and dynamic forces associated with play. The number and size of the spikes and the ground or surface characteristics of the play area all affect the ability of the net to withstand serious play.

A further example of the prior art is evidenced by U.S. Pat. No. 5,269,533 to Kellams. In this configuration, a pair of standards are equipped at the base with a tubular T-joint having two 45 degree elbows in a common plane with the T-joint. Each standard is affixed at its top with a pair of guy lines to keep the standard from bending in due to net tension or play. No support in any of the systems mentioned thus far have any additional tension support for the bottom of the net which is also a consideration in keeping proper tension for play.

Another variation is seen in U.S. Pat. No. 4,415,163 to Schoenig, which employs a plurality of lines attached to the top of telescoping standards. The net is attached to the standards via eyelets in the side margins, and the pole is then tensioned from the top to the ground. Schoenig is unique in its recognition that no substantial base is required at the standard's bottom, but instead, the tensioning of the lines which are attached to the top are advantageous in providing good tension for a net. However, even Schoenig has its disadvantages. The tension between the standard and the ground is prone to loosening and the tension between the net and the pole is prone to loosening. Each separate connection offers a point of tension weakening, and therefore, there are distinct limits to 1) how much tension is applied in each of five connection points for each standard, or ten altogether, and 2) the consistency of tension seen at each standard. A saving grace of Schoenig is the adjustable tensioning provided for the lines which connect the top of the standards and the ground so that the system can be "trimmed" during play. A further disadvantage to Schoenig is the number of connections which must be made in setting up the net.

The net holding assembly of Robl, U.S. Pat. No. 5,326,109 constitutes an improvement over the art previously discussed in that support is provided in the form of lines near the bottom edge of the net. However, as in the previous art, several connections must be made to establish the configuration of support, and therefore, adjustments may be weakened during play or be non-uniform, and the tension adjusting means, or cinch blocks of Robl are also somewhat cumbersome in their operation.

It is an object of the present invention to provide very high net tension to accommodate professional level volleyball play, and also to provide a quick setup for lower level recreational play. What is needed is a method of attachment and adjustment which maximizes tension in the net without relying on the discrete distance between standards, and which provides optimum tensioning of the underside of the net as well as the top.

It is a further object of the present invention to provide a quickly mountable system which can be set up in minutes. The advantages to a system which can be set up quickly, with excellent tension are somewhat obvious, but in the prior art, many ties, clamps, connections or otherwise contribute to a longer setup time; time which could be spent enjoying the sport.

It is also an object of the present invention to provide consistent, adjustable tensioning which will allow the proper amount of tension to be rapidly set, to assure that professional level play is not compromised by de-tensioning of the net during play.

It is also an object of the invention to be quickly set up, quickly taken down and easily transportable, with a minimum of clamps, connections and operational steps required for setup.

It is also an object of the present invention to be rapidly assembled to preset proper net heights for regulation play for women, men, juniors, and others.

SUMMARY OF THE INVENTION

Broadly stated, the present invention is a novel volleyball net support system which encompasses a pair of tubular standards which can be assembled to provide a multiple number of predetermined net heights for low level to professional level play. The system is also intended to be used for badminton or any other game employing similarly positioned nets. For the purposes of this application, the volleyball application will be described, as it is typically the game requiring the most strength and tension in its net. Most good quality volleyball nets have lines running through the top and bottom margins of the net. These lines are typically made of small diameter woven steel cable or some other material of suitable strength and durability. These lines usually have a loop at each end which is used to fasten to whatever support system is being utilized.

The standards employ adjustable guy lines each extending from the top of the standard to two points on the ground, thereby forming a "V." The ground contact points of the guy lines are either directly connected to anchors which are driven or screwed into the ground, or provided with hooks for attaching to the anchors. In one embodiment, the guy lines simply wrap around the anchor or hook and are joined to an adjustable length which connects to the bottom net line as further described below. In the best mode of the present invention the loop of the top line of the net is connected via a releasable ring to a fixed-length line which has its own loop at a predetermined distance along its fixed length. The fixed-length line enters the standard via a slot and projects downward inside the standard where its loop is releasably connected to a ring or other fastening means inside the standard. The fixed-length line extends from the fastening means out through a second slot creating a lower extension which is terminated with a second releasable ring. This lower extension of the fixed length line is located at a preset height to provide a lower positioning of the net top line for women's play.

A second line of fixed length is attached to the loop of the net line extending from the bottom margin of the net via a releasable ring, and extends through the standard via slots at the same height, 180 degrees from each other, i.e., at the net side and outside of the standard. In one embodiment, this second line is connected via a hook or releasable ring to the guy lines extending through the anchors or hooks, thereby forming a "Y," each guy line provided with a means to adjust its length, or to an adjustable-length line which is releasably connected to the guy lines. In this embodiment, the guy lines may be of fixed or adjustable length. In the embodiment where the guy lines terminate at the anchors, the second line is releasably connected to two adjustable-length lines, again forming a "Y." In these embodiments, the tension of the top of the standard and the lower net line can be adjusted in the following ways: by the adjustable guy lines extending through the anchors or hooks and connecting to the second line; by the adjustable-length line which is connected to the guy lines (adjustable or fixed); and by the adjustable-length lines which extend from the anchors to the second line. These adjusting options provide optimum tension for the net and allow any level of play, from recreational to professional. Further, the location of the anchors is not entirely critical although symmetry is preferred, because adjusting standard tension which is connected to the upper net line and the tension of the lower net line establishes system stability. Net tension is therefore directly adjustable at both top and bottom, with trim accomplished in a few steps. The standards simply act to establish net height and facilitate the essentially direct tensioning of the net to the ground.

It should be mentioned, that the above described method of connecting to the net may be modified on the other side of the net by providing stretchable length lines, such as strong bungee cords between the upper and lower fixed lines of the standard.

Therefore, the present invention comprises a net having top and bottom lines extending therethrough, the top lines directly connected to the top of two standards, each standard having guy lines extending through anchors in the ground and adjustably connected to a line which is in tension with the bottom net line either through or around the standard.

DETAILED DESCRIPTION OF THE INVENTION

Figure 1:
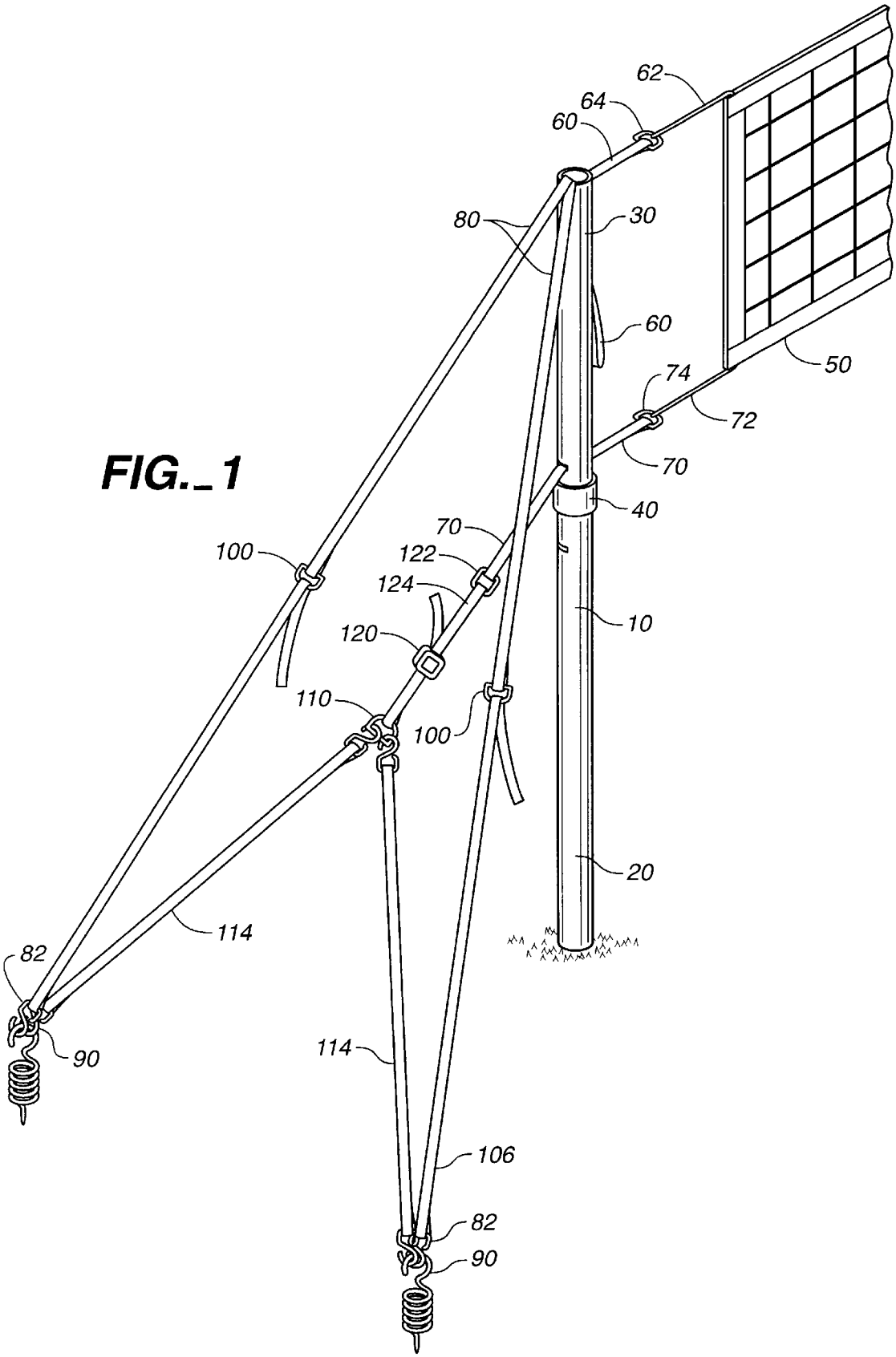
FIG. 1 is a depiction of the present invention in perspective, showing the support system of one of two standards needed to support a volleyball net.

In a preferred embodiment as seen in FIG. 1, a standard 10 is comprised of a lower segment 20 joined to an upper segment 30 at a coupling 40. These segments may be threadably engaged, or a male-female fit with some extension of one segment into the other, or another means of joining two tubular pieces such that they are firmly engaged to withstand lateral movement and flex. A volleyball net 50 is directly connected to two first and second fixed-length lines 60 and 70. Line 60 is connected to the loop of net top line 62 by releasable ring 64. Line 60 enters standard 10 through a slot (not shown) proximate to the top edge of net 50. Line 60 is also shown exiting the standard where it can be used to connect to top line 62 to provide a lower top net height. Two guys 80 are affixed to the top of standard 10 and project downward toward the ground away from one another forming a "V" and are provided with hooks 82 which are releasably connected to anchors 90. Guys 80 may also be connected to anchors 90 by way of integral loops (not shown). In the preferred embodiment of the invention, the anchors are of a coiled configuration to be screwed into the ground for firm hold. Friction buckles 100 are used to adjust the tension in lines 80 rapidly and securely.

In a preferred embodiment line 70 is of fixed length, and is connected to the bottom net line 72. of net 50, passing directly through standard 10. In other embodiments, line 70 may also be directed around the standard, for example, through one or more eyes on either side of the standard rather than through slots provided in the standard. In either embodiment, line 70 may be connected either to guys 80 passing directly through anchors 90 in a "Y" configuration comprised by a releasable ring or hook 110 and two lines 114, or directly to anchors 90. An adjustable buckle 120 is provided to finely adjust the tension of the bottom edge of the net thereby completing a support system which is ultimately capable of simple and final adjustment via the lines directly connected to the net. Guys 80 may be fastening together forming a junction, or may employ an additional releasable ring (not shown).

Where line 70 is connected independent of the guys to anchors 90, line(s) 114 may be connected to anchors 90 via hooks 82. By its direct linkage to the anchors, bottom net line 72, through lines 70 and 114, may be tensioned independently from either of the guys 80.

Figure 2:
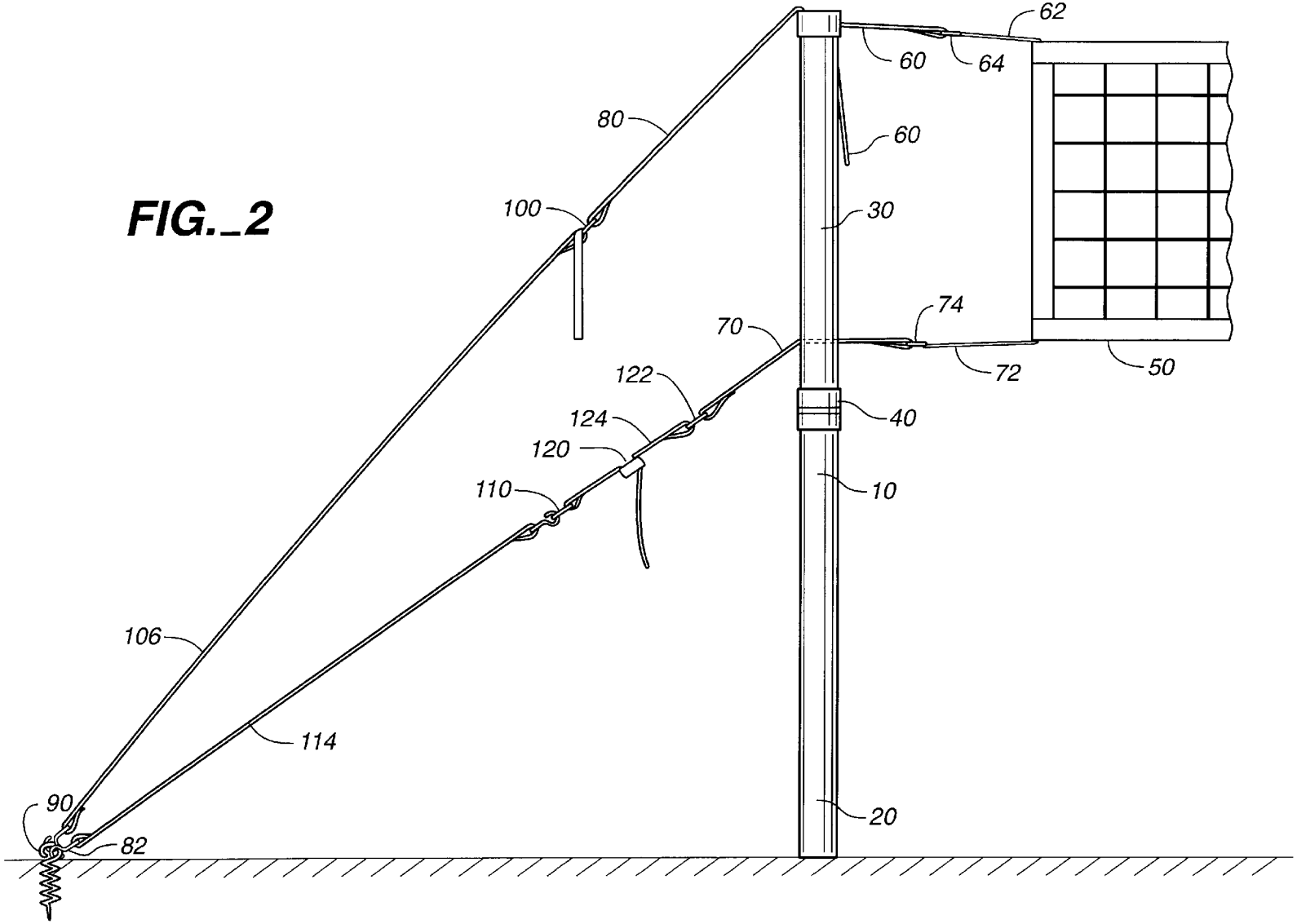
FIG. 2 is a front elevational view of the standard and support system of FIG. 1.

FIG. 2 shows the relative positioning of lines 60 and 70 with respect to net 50. The standard is fashioned to be a predetermined height such that net 50 is at regulation height and the dual support for the standard is further apparent. In this figure, fixed-length line 70 is connected by releasable ring 122 to adjustable-length line 124, which serves to adjust the tension of net bottom line 72.

In an embodiment where guys pass directly through the anchors 90 without any hooks, and are coupled to line 124 via ring 110, the entire tensioning of the top of the standard as well as the bottom line 72 of the net can be accomplished with one tensioning act.

Figure 3:
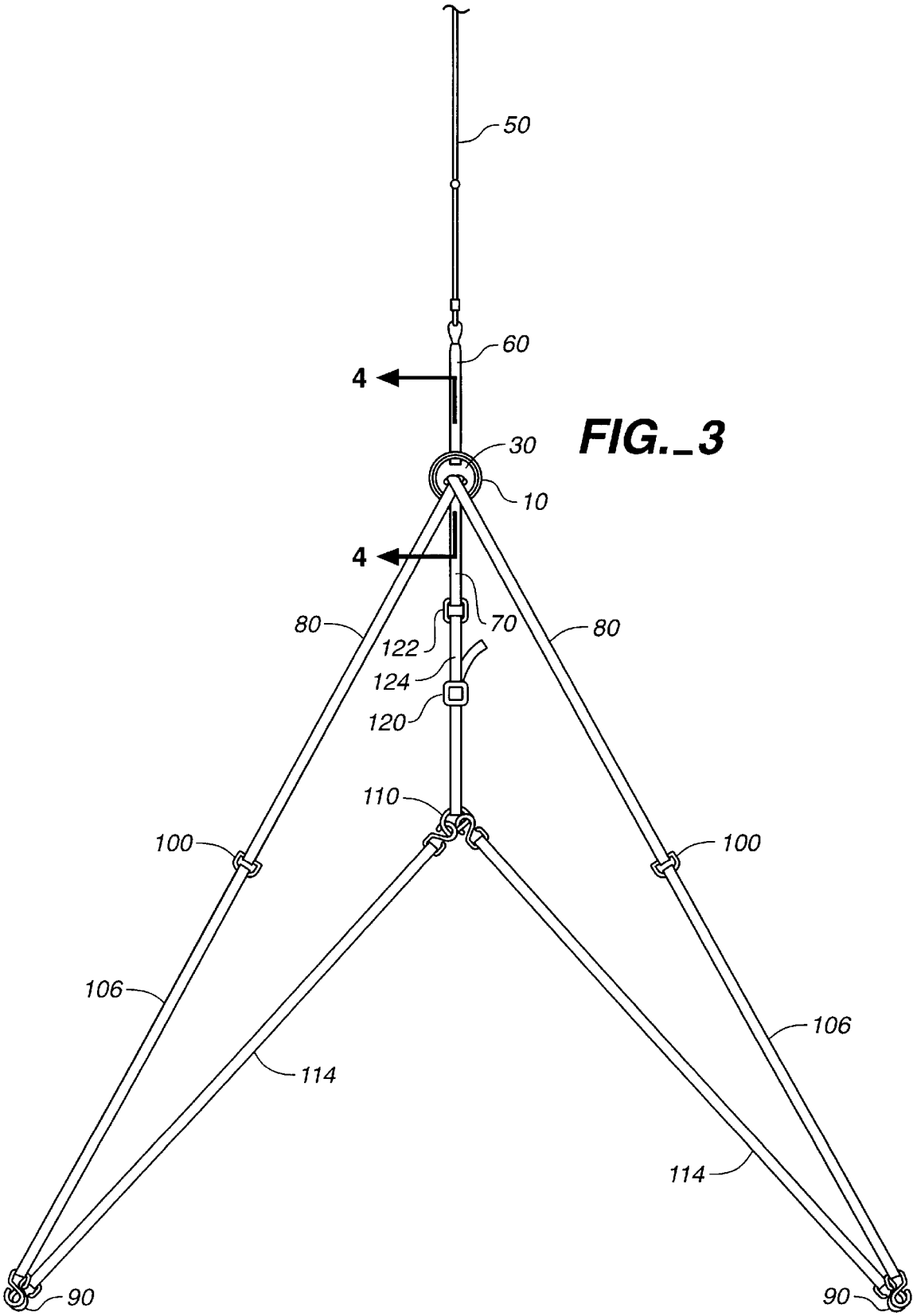
FIG. 3 is a top plan view of the support system in FIGS. 1 and 2 particularly pointing out the guy lines, fixed-length lines and adjustable-length lines of the present invention.

In FIG. 3, the support configuration is again shown, particularly the "V" and "Y" configurations of guys 80 and line(s) 114 , which connect to line 70 via adjustable line 124, and hence bottom net line 72, may be in adjustable tension with anchors 90.

Figure 4:
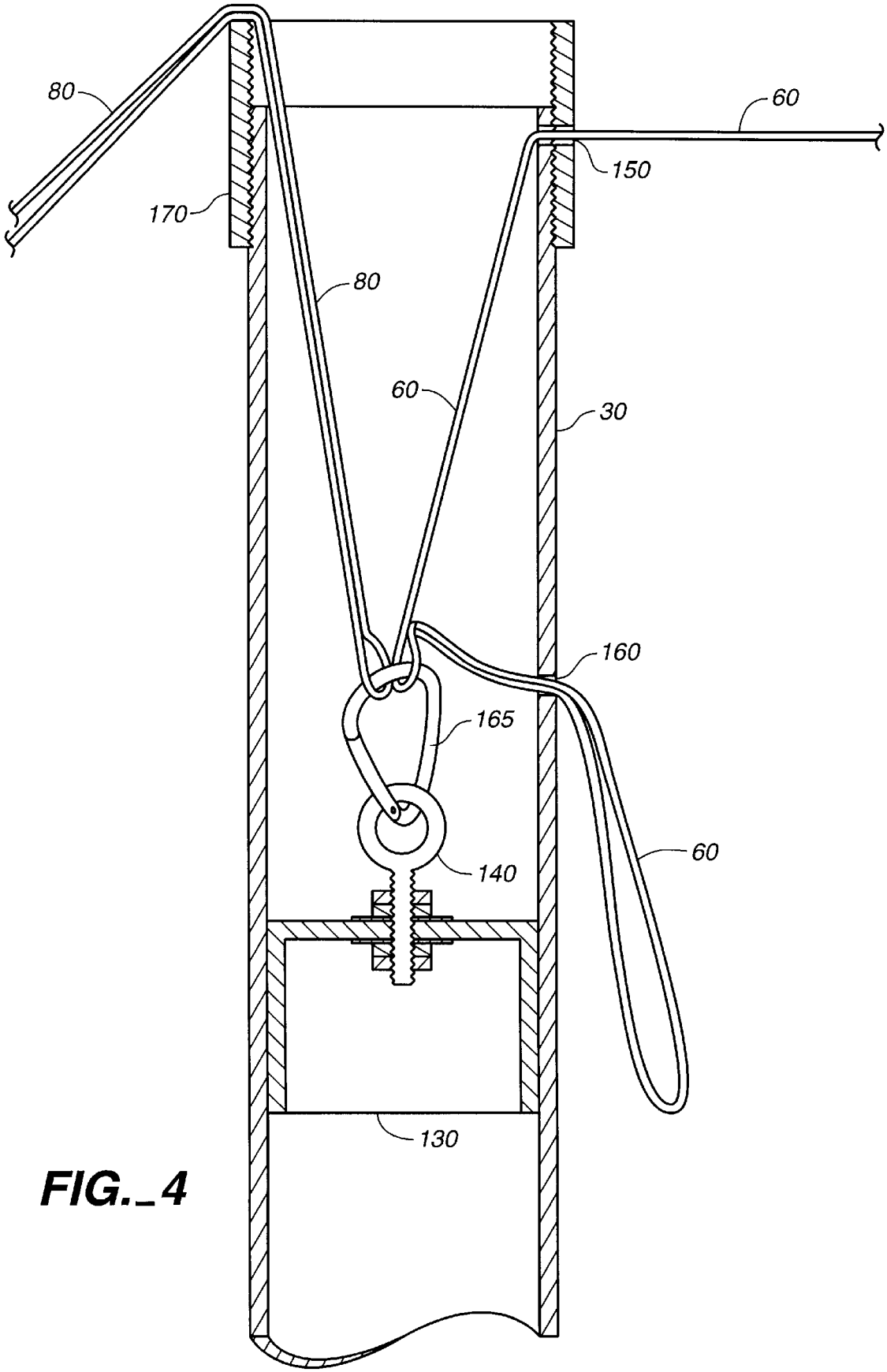
FIG. 4 is a cross-sectional view of one embodiment of the present invention showing the upper area of one of the standards and the relationship of the fixed-length line, whose loop is connected to the net top line, and also showing the guy lines which are also releasably connected to a ring provided in the inside of the standard.

FIG. 4 shows the internal arrangement of the standard section 30. In this embodiment, a cup 130 is engaged with and cemented to the inner wall of standard 10. Said cup 130 may or may not be inverted as shown. Fastened to the cup is an eyebolt 140, providing a point where line 60, connected to net top line 62 (not shown) passing through slot 150, can be affixed via loop 152, thereafter extending through slot 160. In this way, top line 62 becomes fixed to standard 10 at either a net height determined by slot 150, or at a lower net height determined by slot 160. A releasable ring such as a carabiner 165 may be connected with the eyebolt 140 in order to connect guys 80 and line 60 with the standard. When disassembled, the guys, other lines and hardware may be stuffed into the upper portion of the standard, and a threaded cap (not shown) may be threadably engaged to end cap 170 to retain them.

Figure 5:
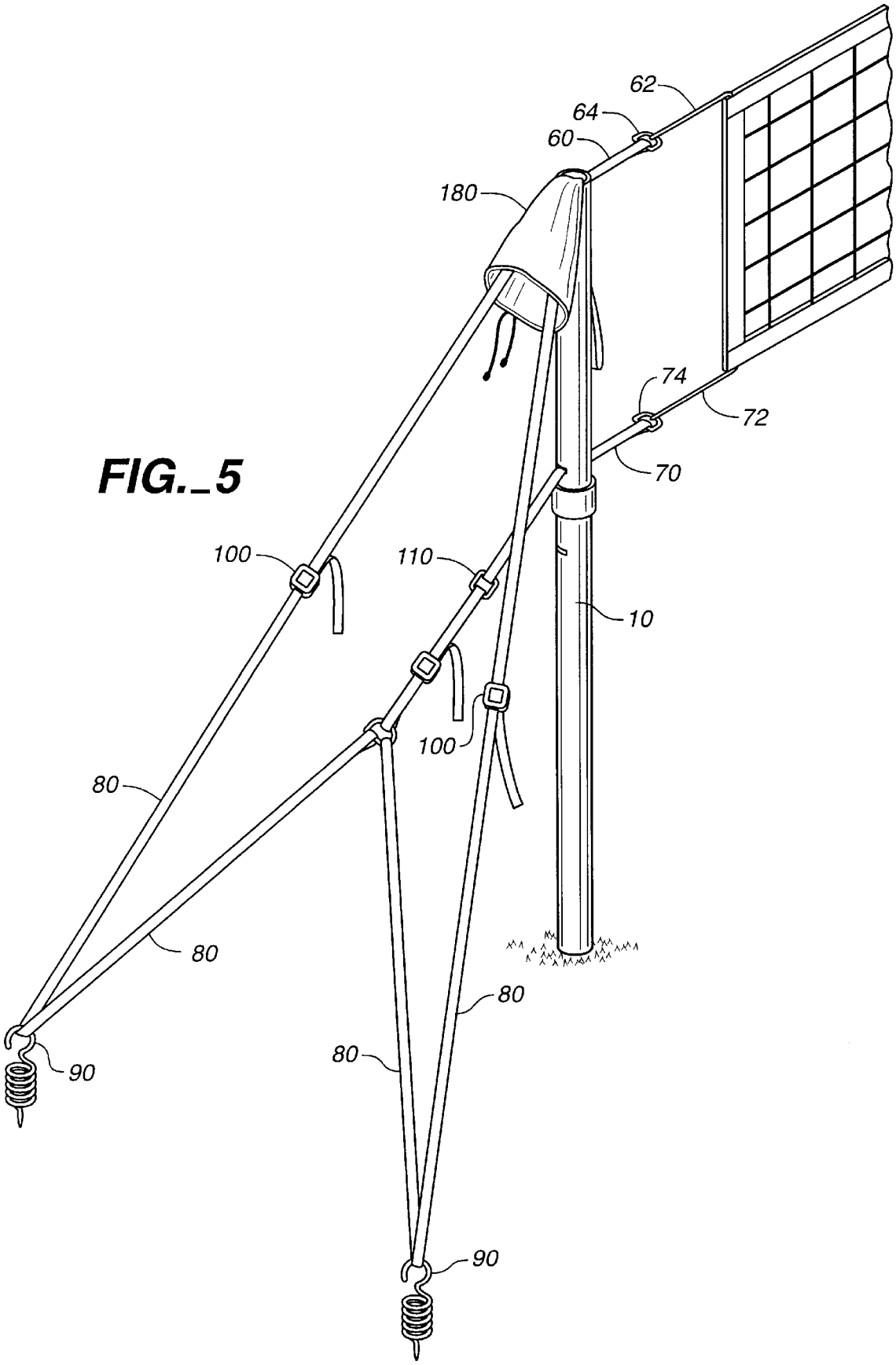
FIG. 5 is a perspective of another embodiment of the present invention where the guy lines pass through a cap atop the standard and are connected with the net top line. A bag is provided to hold the guy lines and other hardware.
Figure 6:
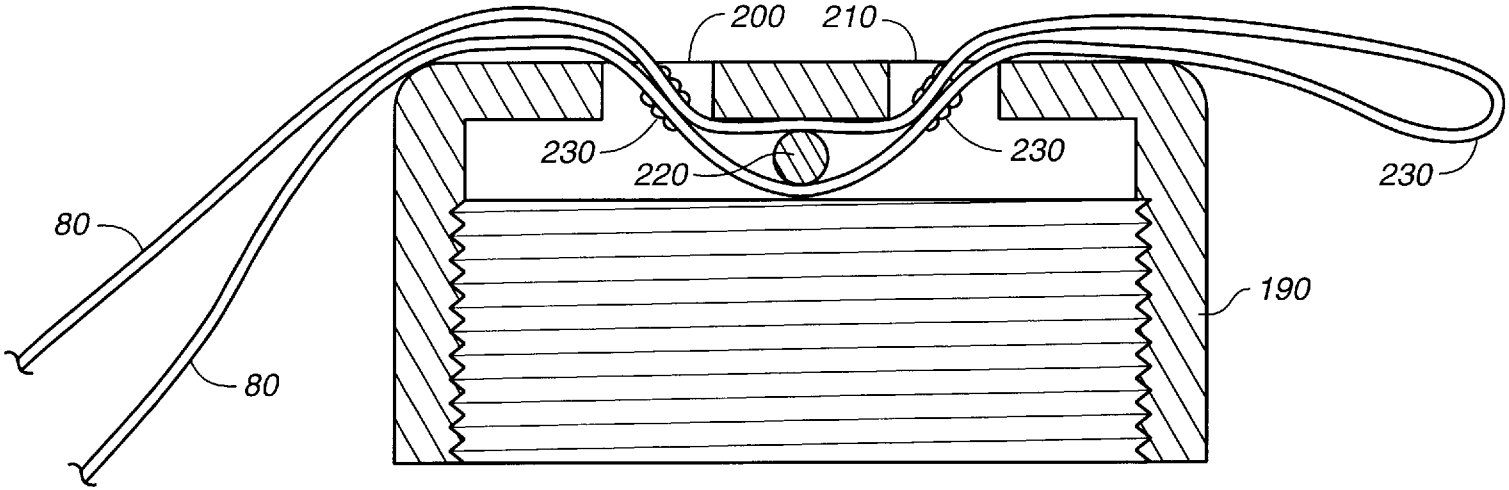
FIG. 6 is a sectional view of the cap of the embodiment of FIG. 5.

FIG. 5 shows another embodiment of the present invention wherein a bag 180 is used in conjunction with a cap fastening means shown in FIG. 6, and the guys pass through the anchors to allow single tensioning of the system.

FIG. 6 is a cross section of a cap 190 which is frictionably engaged to the upper end of section 30, providing a fastening point for guys 80 at the top of the standard, and is held in place by the downward force of the guys. A pair of slots 200 and 210 allow guys 80 to pass through the cap, retained by tension exerted by dowel 220, captured between two connected portions of the guys via the threaded sections 230 shown in this embodiment. A loop 230 is created which provides the same function as line 60 in the preferred embodiment, releasably connecting to net top line 62 through a releasable ring 64. In the embodiment of FIG. 6, more than one net height is possible by using belled ends of different length on the lower section of the standard. In this way, for one net height, one end of the lower half standard may be used to engage the upper half, and for a lower net height, the lower half may be reversed, allowing a deeper bell end to engage more of the upper standard's length in order to accomplish a lower net height.

While the invention has been described in connection with what is presently considered the most practical and preferred embodiment(s), it is to be understood that the invention is not limited to the disclosed embodiment(s) but, on the contrary is intended to cover various modifications and equivalent arrangements included within the scope of the appended claims.

What is claimed is:

1. A portable net support system comprising:

a pair of standards;

at least two anchors engaged in a playing surface;

a net of predetermined length having a top line and a bottom line extending therethrough, said top line releasably connected to the top of said standards;

guys extending from the top of said standards to said anchors;

at least two lines extending from said anchors through said standards in tension with said bottom line;

adjusting means for tensioning said guys and said bottom line.

2. The net support system as described in claim 1 wherein:

said anchors comprise hooks with a coiled configuration which may be screwed into said playing surface.

3. The net support system as described in claim 1 wherein:

said adjustment means comprising friction buckles.

4. A portable volleyball net and stand comprising:

a rectangular net having a top line extending through its top margin and a bottom line extending through its bottom margin, said top line and bottom line each forming loops at each end thereof;

a pair of standards of predetermined height located a predetermined distance apart to accommodate said net, said standards having a net side and an outside, each of said standards having a first pair of slots on its net side proximate to the top of said standard, one of said first slots proximate to the top edge of said net, the other of said first slots located a predetermined distance therebelow, each of said standards having a second and third pair of slots proximate to the bottom edge of said net, said second pair of slots positioned opposite each other on the net side and the out side of said standards and located a distance approximately equal to the height of said net from the upper of said first pair of slots, said third pair of slots positioned opposite each other on the net side and the out side of said standards and located a distance approximately equal to the height of said net from the lower of said first pair of slots;

a ring fixed inside said standards at a predetermined distance from said standards' tops;

a first line having a loop along its length, said first line releasably connected to the loop of said top net line and extending through the upper of said first slots, said first line extending downward, said first line's loop engaged with said ring, said first line also extending through the lower of said first slots;

a second line connected to said bottom net line and extending through either of said second or third pairs of slots;

a pair of guys attached to the top of each standard and projecting away from each other toward the ground;

a plurality of anchors engaged in a playing surface for attaching said guys thereto;

at least one line connecting said second line to said guys for tensioning said bottom net line;

adjusting means for tensioning said guy lines and said bottom net line.

* * * * *